US006383056B1

(12) United States Patent
Wang

(10) Patent No.: US 6,383,056 B1
(45) Date of Patent: May 7, 2002

(54) PLANE CONSTRUCTED SHAFT SYSTEM USED IN PRECISION POLISHING AND POLISHING APPARATUSES

(76) Inventor: Yin Ming Wang, 2826 N. Keller Dr., Stillwater, OK (US) 74075

( * ) Notice: Subject to any disclaimer, the term of this patent is extended or adjusted under 35 U.S.C. 154(b) by 0 days.

(21) Appl. No.: 09/727,690

(22) Filed: Dec. 4, 2000

Related U.S. Application Data

(60) Provisional application No. 60/168,383, filed on Dec. 2, 1999.

(51) Int. Cl.[7] ..... B24B 7/04

(52) U.S. Cl. ..... 451/5; 451/378

(58) Field of Search ..... 451/378.5, 386, 451/391

(56) References Cited

U.S. PATENT DOCUMENTS

| | | | | |
|---|---|---|---|---|
| 2,354,970 | A | * 8/1944 | Vollkel | 451/391 |
| 4,896,459 | A | 1/1990 | Brandt | |
| 4,897,966 | A | 2/1990 | Takahashi | |
| 5,081,795 | A | 1/1992 | Tanaka et al. | |
| 5,227,339 | A | 7/1993 | Kishii | |
| 5,230,184 | A | 7/1993 | Bukhman | |
| 5,254,205 | A | 10/1993 | Tsutsumi et al. | |
| 5,285,597 | A | 2/1994 | Hinzen | |
| 5,297,361 | A | 3/1994 | Baldy et al. | |
| 5,377,451 | A | 1/1995 | Leoni et al. | |
| 5,398,459 | A | 3/1995 | Okumura et al. | |
| 5,441,442 | A | 8/1995 | Haisma et al. | |
| 5,441,444 | A | 8/1995 | Nakajima | |
| 5,443,416 | A | 8/1995 | Volodarsky et al. | |
| 5,449,316 | A | 9/1995 | Strasbaugh | |
| 5,476,414 | A | 12/1995 | Hirose et al. | |
| 5,487,697 | A | 1/1996 | Jensen | |
| 5,527,209 | A | 6/1996 | Volodarsky et al. | |
| 5,538,465 | A | 7/1996 | Netsu et al. | |
| 5,549,502 | A | 8/1996 | Tanaka et al. | |
| 5,549,511 | A | 8/1996 | Cronin et al. | |
| 5,567,199 | A | 10/1996 | Huber et al. | |
| 5,584,746 | A | 12/1996 | Tanaka et al. | |
| 5,584,751 | A | 12/1996 | Kobayashi et al. | |
| 5,588,902 | A | 12/1996 | Tominaga et al. | |
| 5,595,529 | A | 1/1997 | Cesna et al. | |
| 5,620,357 | A | 4/1997 | Misaka et al. | |
| 5,643,053 | A | 7/1997 | Shendon | |
| 5,649,855 | A | 7/1997 | Chikaki | |
| 5,678,964 | A | 10/1997 | Dashevsky | |
| 5,707,274 | A | 1/1998 | Kim et al. | |
| 5,716,258 | A | 2/1998 | Metcalf | |

OTHER PUBLICATIONS

*Lapmaster Accupol Precision Lapping/Polishing Fixture*, Technical Product Description, Lapmaster International Ltd., Devon, England; 2 pages.

*PP5 Precision Polishing Jigs*, Technical Product Description, Logitech Ltd., Glasgow, Scotland; 2 pages.

*PP6 Precision Lapping & Polishing Jig*, Technical Product Description; LOgitech Ltd., Glasgow, Scotland; 2 pages, dtd Jun. 2, 1997.

* cited by examiner

*Primary Examiner*—Joseph J. Hail, III
*Assistant Examiner*—Anthony Ojini
(74) *Attorney, Agent, or Firm*—James Creighton Wray; Meera P. Narasimhan

(57) ABSTRACT

A plane constructed shaft system used to replace the cylindrical shaft in precision polishing apparatuses. Thus, the accuracy, productivity and cost of polishing apparatuses are improved. The shaft system has a four-surface hollow prism bushing and a four-surface prism shaft that can slide freely within the bushing. The polishing pressure is maintained by the weights of the shaft plus the parts attached to the shaft, but this pressure can be reduced by adjusting a load adjusting nut which compresses a loading spring acting on a collar stop attached to the shaft. The actual polishing pressure can be calculated according to the position of the load adjusting nut. Furthermore, the stock removal amount can be controlled by a stock removal stop ring which is mounted on the collar stop and can be adjusted up and down as required.

33 Claims, 8 Drawing Sheets

PLANE CONSTRUCTED SHAFT SYSTEM USED IN PRECISION POLISHING AND POLISHING APPARATUSES

This application claims the benefit of U.S. Provisional Application No. 60/168,383, filed Dec.2, 1999.

BACKGROUND OF THE INVENTION

1. Field of Invention

This invention relates to precision polishing apparatuses, in particular to an improved shaft system for more uniform polishing at lower cost.

2. Prior Art

As science and technology advance, the requirements of flatness and parallelism for surfaces of certain components become more and more precise. High precision surfaces are required in the manufacture of semiconductors, electro-optic equipment, and optical instruments, as well as many other scientific applications. Consequently, many polishing machines and polishing apparatuses have been developed for improving the flatness and parallelism of polished surfaces.

As shown in FIG. 1, a conventional polishing machine includes an annular polishing pad 12 which is mounted on a polishing plate 11 and rotated in the horizontal around a vertical axis passing through the center of pad 12. An object 13 to be polished is fixedly but releasably mounted on a carrier 14. Carrier 14 with object 13 is placed on polishing pad 12. The upper surface of polishing pad 12 is the polishing surface and the bottom surface of object 13 is the surface to be polished. In order to protect the surface to be polished, a conditioning ring 15 is used around object 13. Flat and parallel surfaces can only be achieved if there is uniform removal of stock from the surface to be polished. For this purpose, the surface to be polished should move downwards without yaw in the course of polishing. Namely, the surface to be polished should always remain parallel to its previous position during the process of polishing.

Many methods and apparatuses have been developed for the purpose of keeping the surface to be polished in a series of parallel planes in the course of polishing. One of the developed methods involves connecting the carrier and the conditioning ring by a sheet of special material which is stiff in its own plane but flexible in the direction perpendicular to the sheet plane, as described in the U.S. Pat. No. 5,716,258 of Robert L. Metcalf, 1998. In that case, the object to be polished will be moved with the conditioning ring on the polishing pad as a single unit, but the object to be polished can be freely moved up and down relative to the conditioning ring as needed. The shortcoming of this method is that the connection is neither strong nor precise enough.

Another method of connecting the carrier and the conditioning ring is by means of a cylindrical shaft system. As shown in FIG. 2, a shaft 17 is fixed on carrier 14, and a bushing 16 is fixed on a conditioning ring with top 15A. Shaft 17 can be freely moved along its axis within bushing 16. Bushing 16 and shaft 17 are used to control the movement of object 13. Object 13 assembled together with carrier 14 and shaft 17 as a single unit is rotated with conditioning ring 15A synchronously on the polishing surface. At the same time, object 13 can also move down freely relative to conditioning ring 15A as the stock is removed from the surface to be polished. If the object to be polished moves up and down without yaw, flat and parallel surfaces will be obtained. Two English companies (Logitech Ltd. and Lapmaster International Ltd.) manufacture this type of polishing apparatus. The problem with this connecting method by a shaft system is that it is very difficult to manufacture such a precision cylindrical surface. While the shaft moves along its axis within the bushing, possible lateral movement (yaw) is caused by the clearance between the shaft and the bushing. Supposing the connecting length between the shaft and the bushing in direction of axis is 55 mm, a clearance of 0.5 $\mu$m may cause 2" (angular amount) of yaw in the movement of the shaft. This 0.5 $\mu$m clearance is controlled by the dimensional tolerance and geometric tolerance of the shaft and the bushing. The yaw will translate to the surface to be polished as errors of flatness and parallelism. Therefore, the amount of yaw is controlled by the dimensional and geometric tolerance of the shaft and the bushing. Even with the use of expensive ultra-precision equipment, it is not easy to manufacture and verify, with sub-micron accuracy, a cylindrical surface. Thus, the accuracy of polishing apparatuses with cylindrical shaft systems is limited. What is more, the dimensional tolerance and geometric tolerance must be satisfied simultaneously during manufacture, or the shaft and/or bushing will not be usable. Even a highly skilled machinist has trouble consistently producing high quality cylindrical shafts. For the same reasons, once the shaft or/and the bushing becomes worn, it is difficult to repair and the worn shaft system usually is simply discarded. Consequently, the costs involved with the production and use of precision polishing apparatuses with cylindrical shaft systems are very high.

SUMMARY OF THE INVENTION

In this invention, a plane constructed shaft system is used to replace the cylindrical shaft system in the precision polishing apparatus. The advantages of the plane constructed shaft system are:

1. Since the cylindrical surface is replaced by plane surfaces in the improved shaft system, only general equipment such as lapping/polishing machinery and optical flats are needed to manufacture the plane constructed shaft system, and therefore even a machinist with only general skills can do this job.

2. The clearance between the shaft and the bushing can be adjusted or reduced to a very small amount by a special manufacturing/assembling method in which we don't have to consider the dimensional tolerance, but just pay attention to the geometric tolerance. Consequently, the accuracy of the plane constructed shaft system will be more precise than that of the cylindrical shaft system.

3. No parts in this plane shaft system need be discarded because of over polishing in the manufacturing. The productivity of this plane shaft system will be much higher than that of the cylindrical shaft system.

4. The parts in this plane shaft system can be repaired after they wear out. Consequently, the lifetime of this plane shaft system will be prolonged indefinitely.

5. The flat parts of this plane shaft system can be polished by another polishing apparatus of the plane shaft type, and this will yield better flatness and parallelism. Thus the next generation polishing apparatus will be even better, making the manufacturing process a spirit up cycle.

6. A polishing apparatus equipped with a plane constructed shaft system will be more precise and lower in cost. Furthermore, a precision polishing apparatus equipped with a polishing pressure detecting device and a stock removal controlling device will be more efficient.

Further objects and advantages of this invention are illustrated in the ensuing drawings and descriptions.

These and other objects and features of the invention are described in the disclosure, which includes the above and ongoing written specifications, along with the claims and the drawings.

| Reference Numbers in Drawings | |
|---|---|
| 11 | polishing plate |
| 12 | polishing pad |
| 13 | object to be polished |
| 14 | carrier |
| 15 | conditioning ring |
| 15A | conditioning ring with top |
| 16 | bushing |
| 16A | plane constructed bushing |
| 16A-1 | top clamping plate |
| 16A-2 | spacer plate |
| 16A-3 | bottom clamping plate |
| 17 | shaft |
| 17A | plane constructed shaft |
| 18 | collar stop |
| 19 | loading spring |
| 20 | stock removal stop ring |
| 21 | load adjusting nut |
| 22 | ruler |
| 23 | clamp screw |
| 24 | flat plate |
| 25 | sleeve |
| 26 | epoxy |
| 27 | connecting screw |
| 28 | connecting ring |
| 29 | flat plate with tapped hole |
| 30 | set screw |

DETAILED DESCRIPTION OF THE PREFERRED EMBODIMENTS

Figure 1:
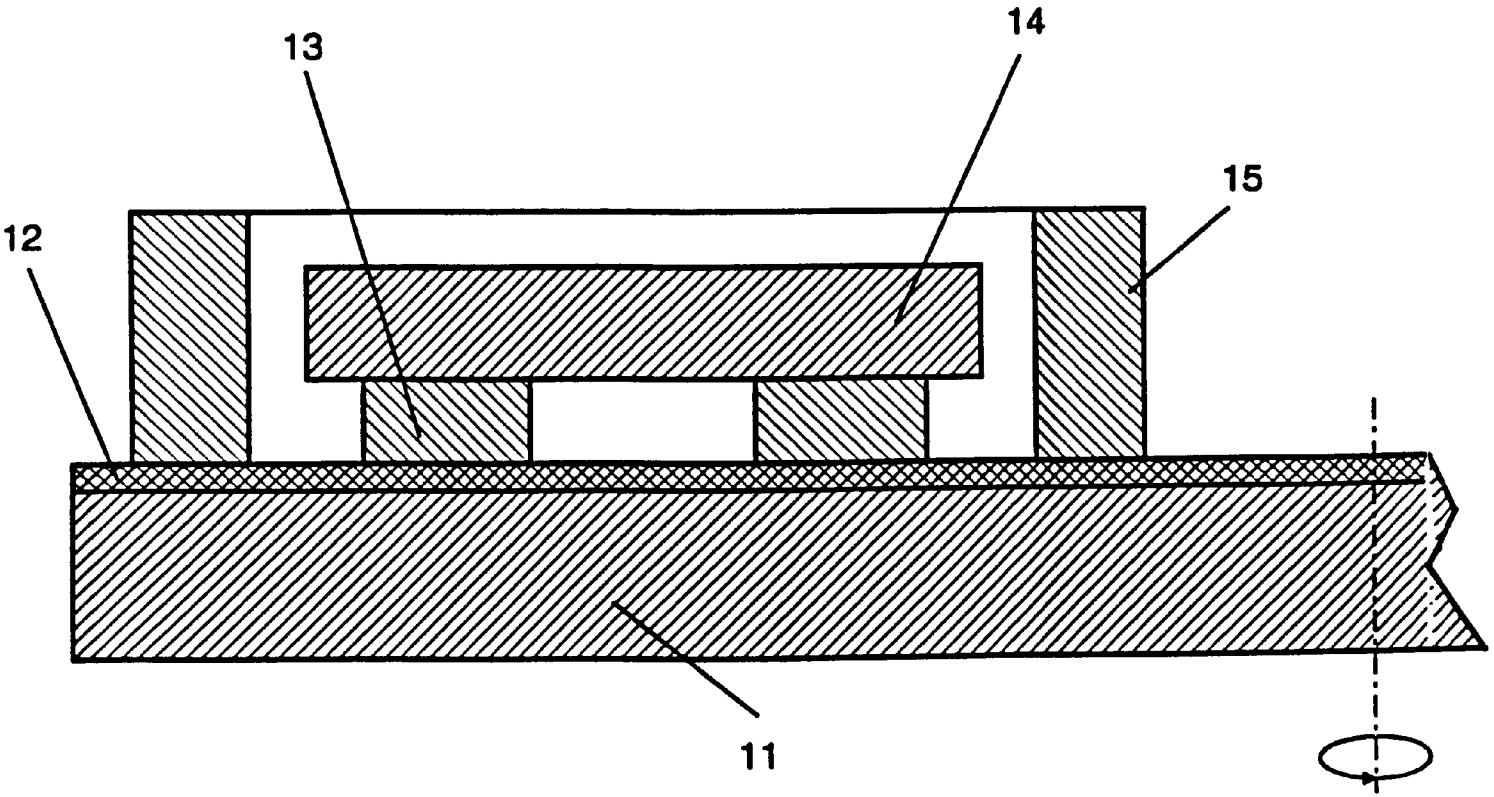
FIG. 1 (Prior Art)
FIG. 1 shows a conventional polishing apparatus in place on the polishing surface of a polishing machine.
Figure 2:
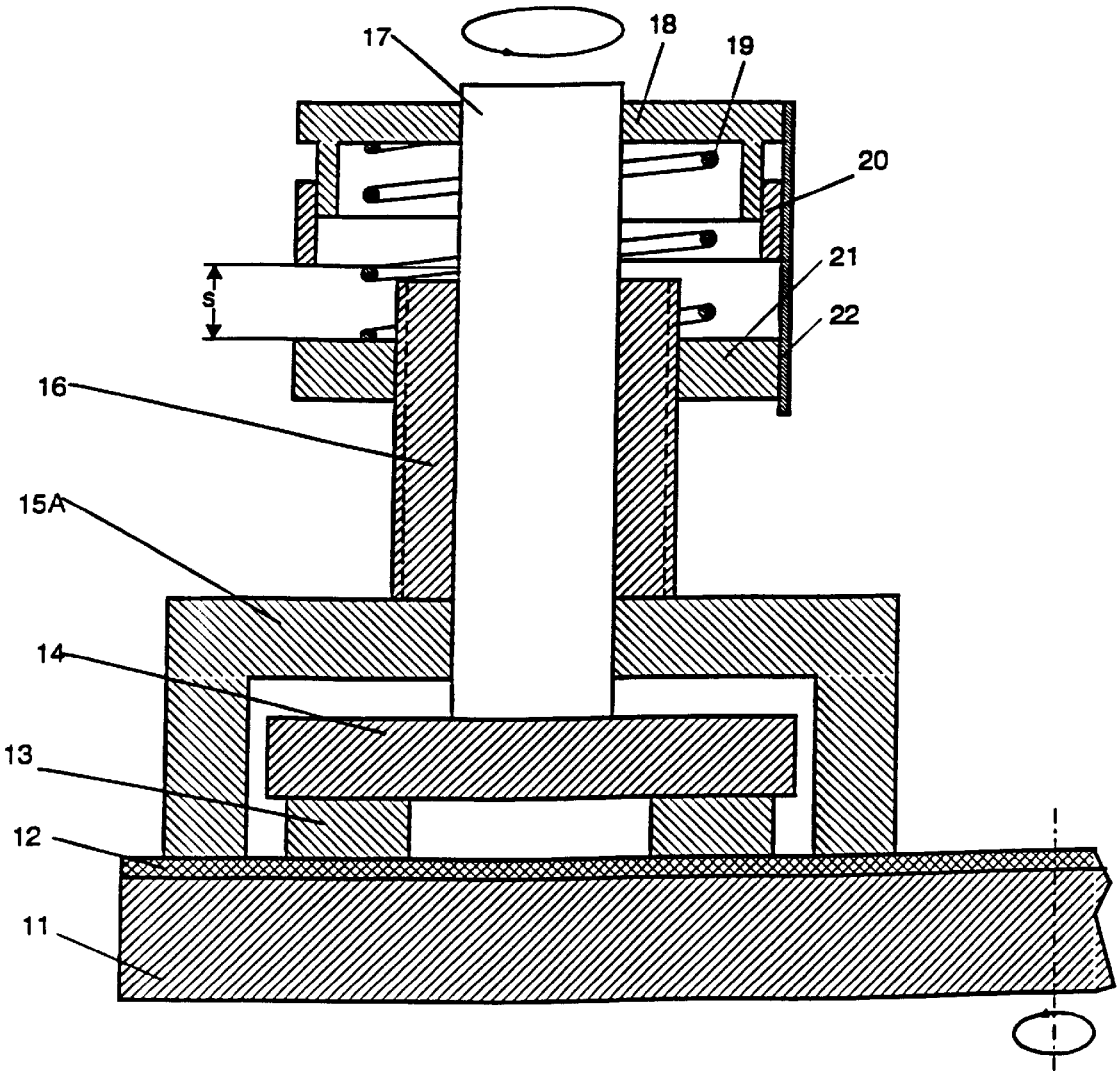
FIG. 2 shows a polishing apparatus constructed by a shaft system in place on the polishing surface of a polishing machine.

FIG. 2 is a cross section sketch of a precision polishing apparatus constructed by a shaft system. Object 13 to be polished is fixedly and releasably held by a holding plate—carrier 14. One or more objects can be held on carrier 14 by wax or vacuum pressure. The bottom surface of object 13 is the surface to be polished. A shaft 17 is fixed on carrier 14 as a solid assembly. In order to protect the surface to be polished, a conditioning ring with top 15A is used to surround object 13. A bushing 16 is fixed on conditioning ring 15A as a solid assembly. With sliding fits between shaft 17 and bushing 16, shaft 17 can be moved freely within bushing 16. Both the bottom surface of conditioning ring 15A and the bottom surface of object 13 are placed on a polishing pad 12 which is attached on a polishing plate 11 of a polishing machine. Plate 11 together with pad 12 rotates around a vertical axis, passing through its center. The polishing pressure between the surface to be polished and pad 12 is the total weight of object 13, carrier 14 and shaft 17 assembly. This polishing pressure can be adjusted by a load adjusting nut 21. As nut 21 is adjusted upwards along bushing 16, a loading spring 19 is compressed, pushing a collar stop 18 which is fixed on shaft 17. Thus the polishing pressure is reduced.

In the course of polishing, the polishing apparatus is moved by the frictional forces between the polishing apparatus and pad 12 and is blocked by a fork (not shown) which is mounted on the polishing machine. Two rollers (not shown) that hold the polishing apparatus at the outside periphery of conditioning ring 15A are mounted on the fork. The polishing apparatus is driven by the frictional forces mentioned above and rotates around its own axis related to polishing pad 12. In the course of polishing, shaft 17 together with carrier 14 and object 13 is rotated with conditioning ring 15A synchronous on pad 12 and can be moved up and down relative to conditioning ring 15A. Thus the bottom surface of object 13, which is always co-planar with the bottom surface of conditioning ring 15A, is polished.

Figure 3:
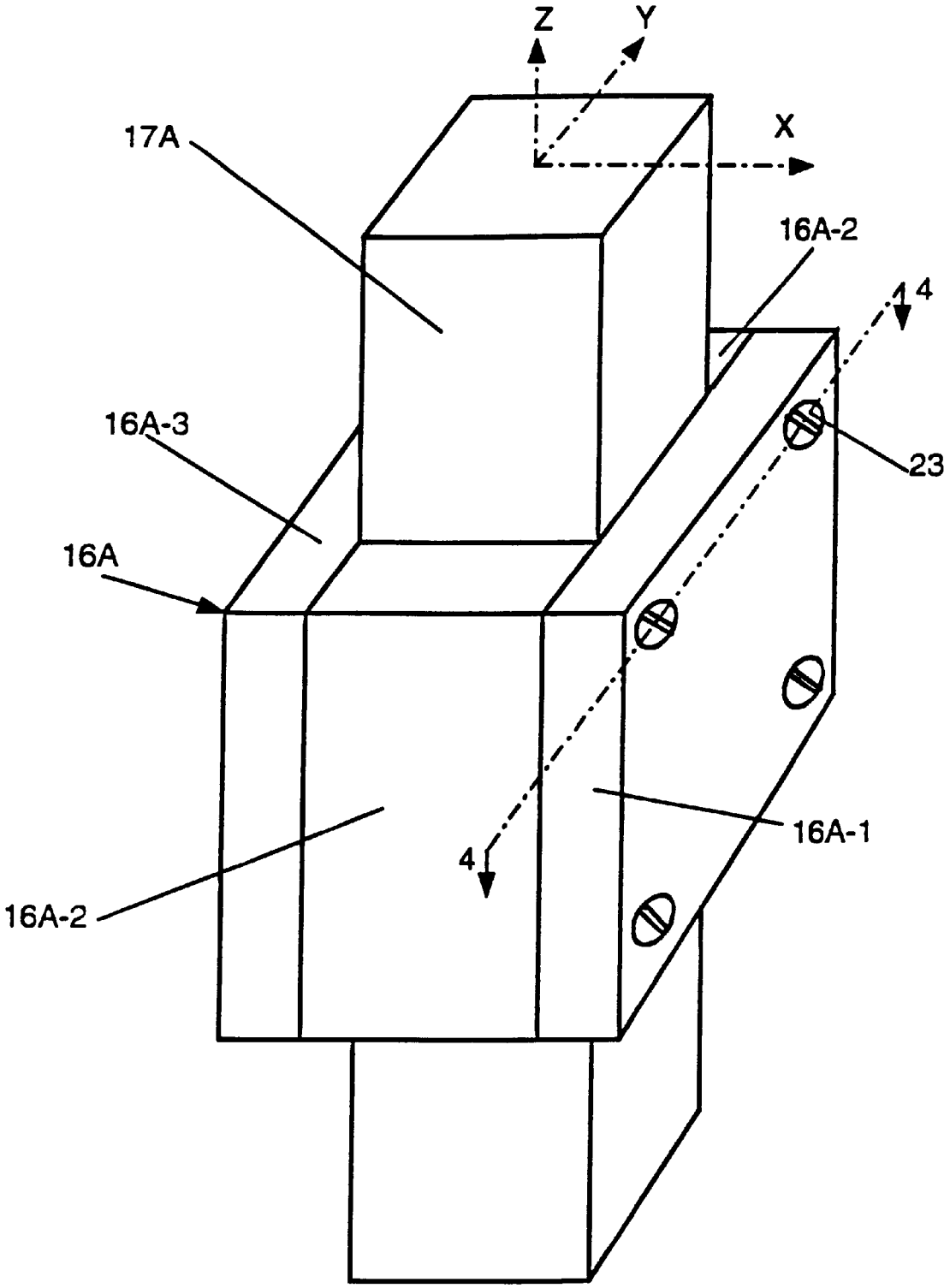
FIG. 3 is an isometric-view of a plane constructed shaft system.
Figure 4:
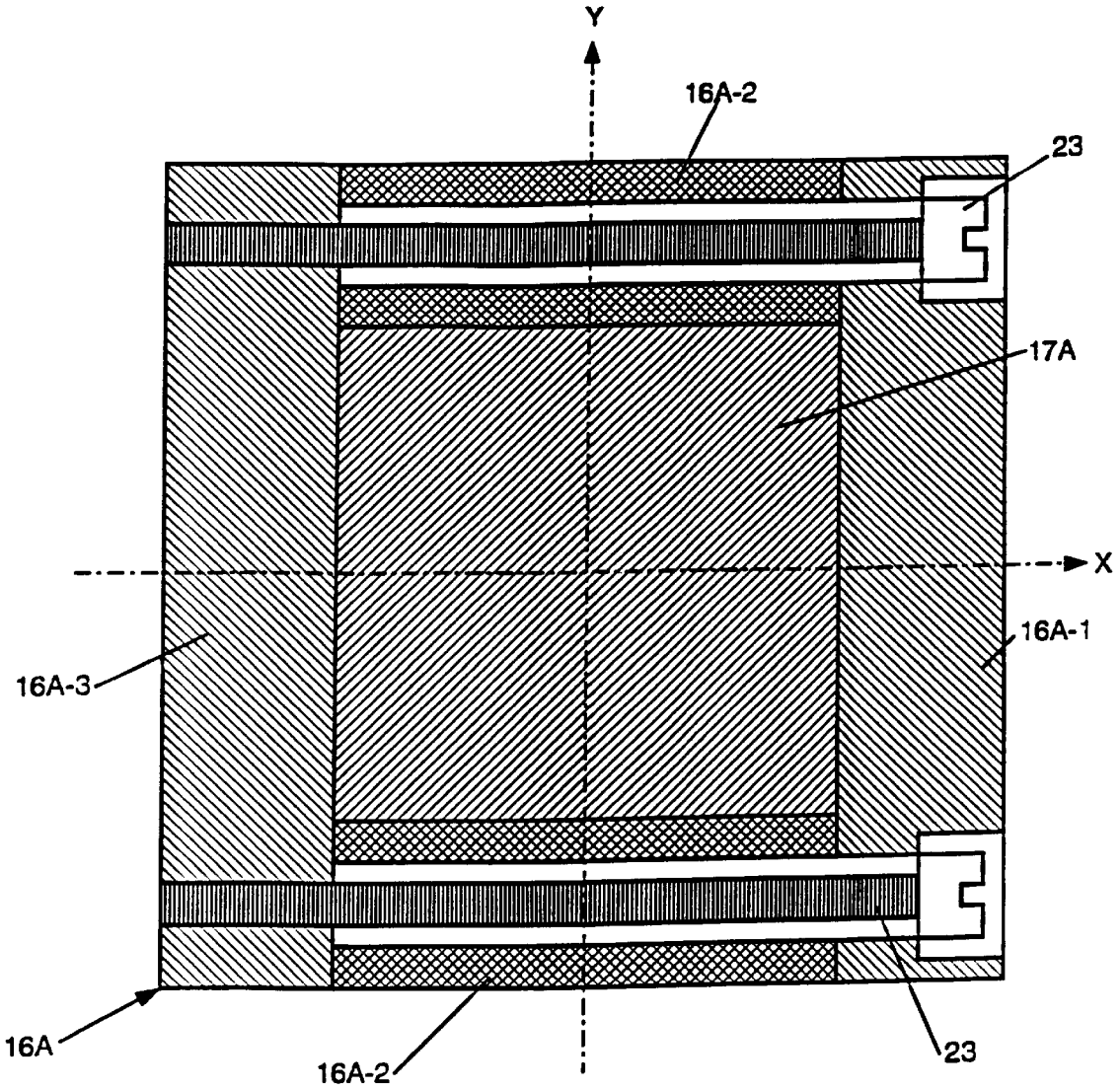
FIG. 4 shows a cross section view of a shaft system constructed with plane surfaces.

In order to get a flat surface, shaft 17 together with carrier 14 and object 13 should slide up and down within bushing 16 without yaw. If both the bottom and top surface of object 13 need to be polished, the parallelism of these two surfaces can be controlled. For the purposes of improving flatness and parallelism, ease of manufacture and low cost, this invention improves upon the old cylindrical shaft system. The invention is a shaft system constructed of planes, specifically, a rectangular prism shaft system as shown in FIG. 3 and FIG. 4. A rectangular shaft 17A is surrounded by a rectangular bushing 16A which is constructed of two spacer plates(16A-2), a top clamping plate(16A-1) and a bottom clamping plate(16A-3). They are connected by four clamp screws 23 which pass through the holes in top clamping plate 16A-1 and holes in spacer plates 16A-2. They then screw into the tapped holes in bottom clamping plate 16-3. This plane constructed shaft system (16A and 17A) is used to replace the cylindrical shaft system (16 and 17) in FIG. 24.

Shaft 17A can slide within bushing 16A. If there is some clearance between shaft 17A and bushing 16A, it will cause shaft 17A to move a little bit in both X and Y directions as shaft 17A slides des within bushing 16A, i.e., cause the shaft 17A to yaw.

The X-direction clearance between shaft 17A and bushing 16A is controlled by the X-direction dimensions of shaft 17A and two plates 16A- 2. If these three parts are bound together and manufactured simultaneously, we don't have to pay attention to the dimensional tolerance, only to the geometric tolerance. These three parts will have the same dimensions in the X-direction, and thus the clearance between shaft 17A and bushing 16A in X-direction can be reduced, even to zero.

Figure 5A:
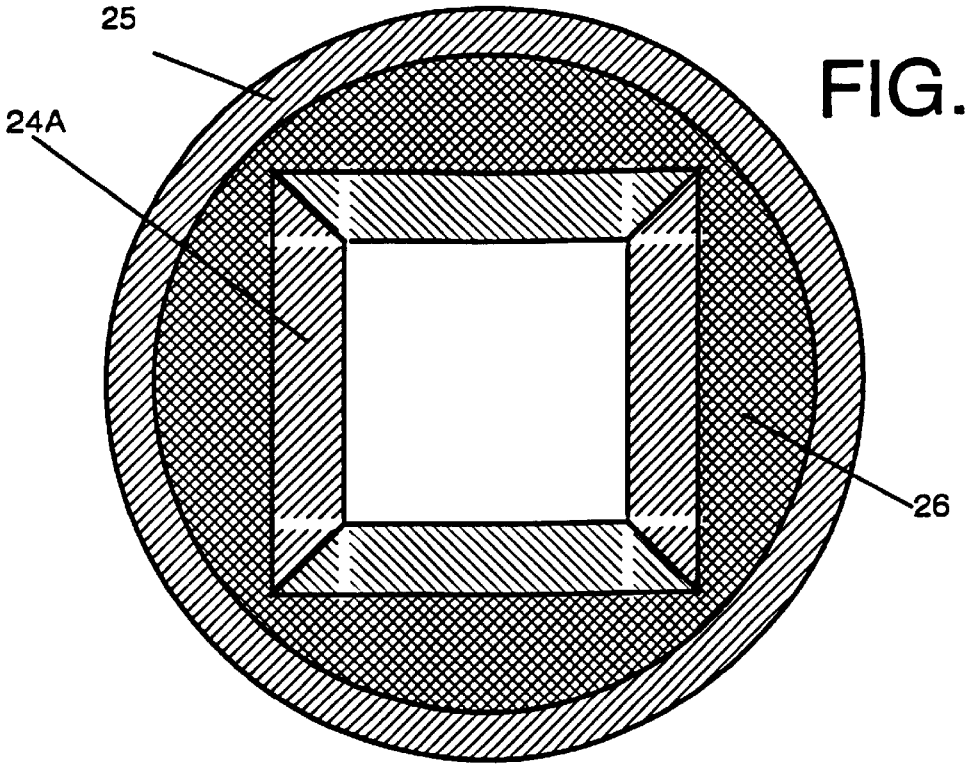
FIG. 5A and FIG. 5B show two possible constructions of plane constructed bushing.
Figure 5B:
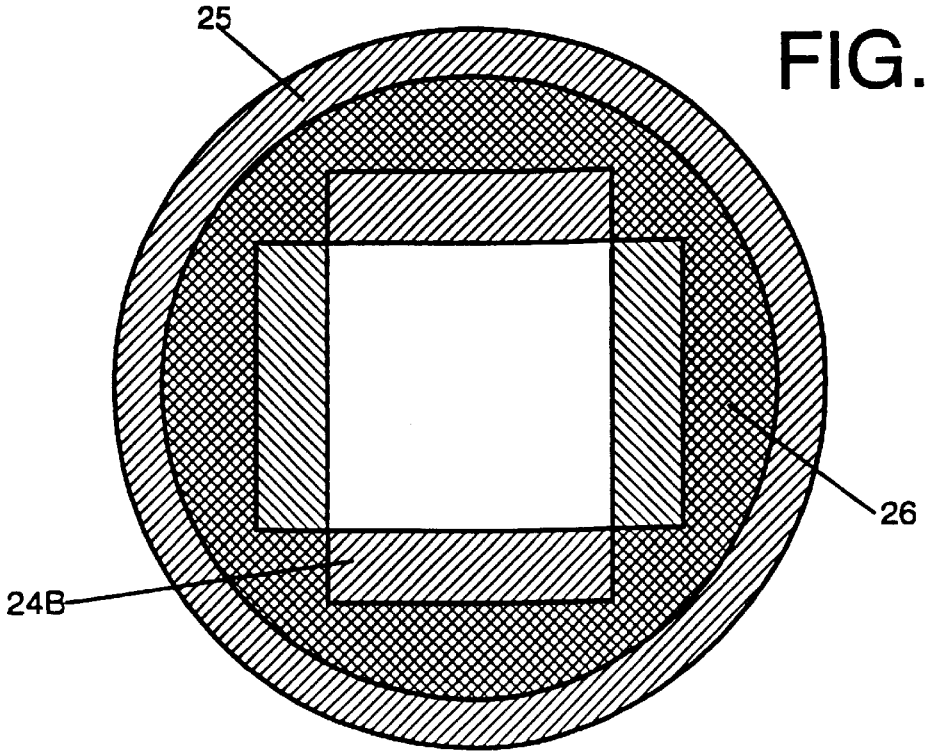
Figure 6A:
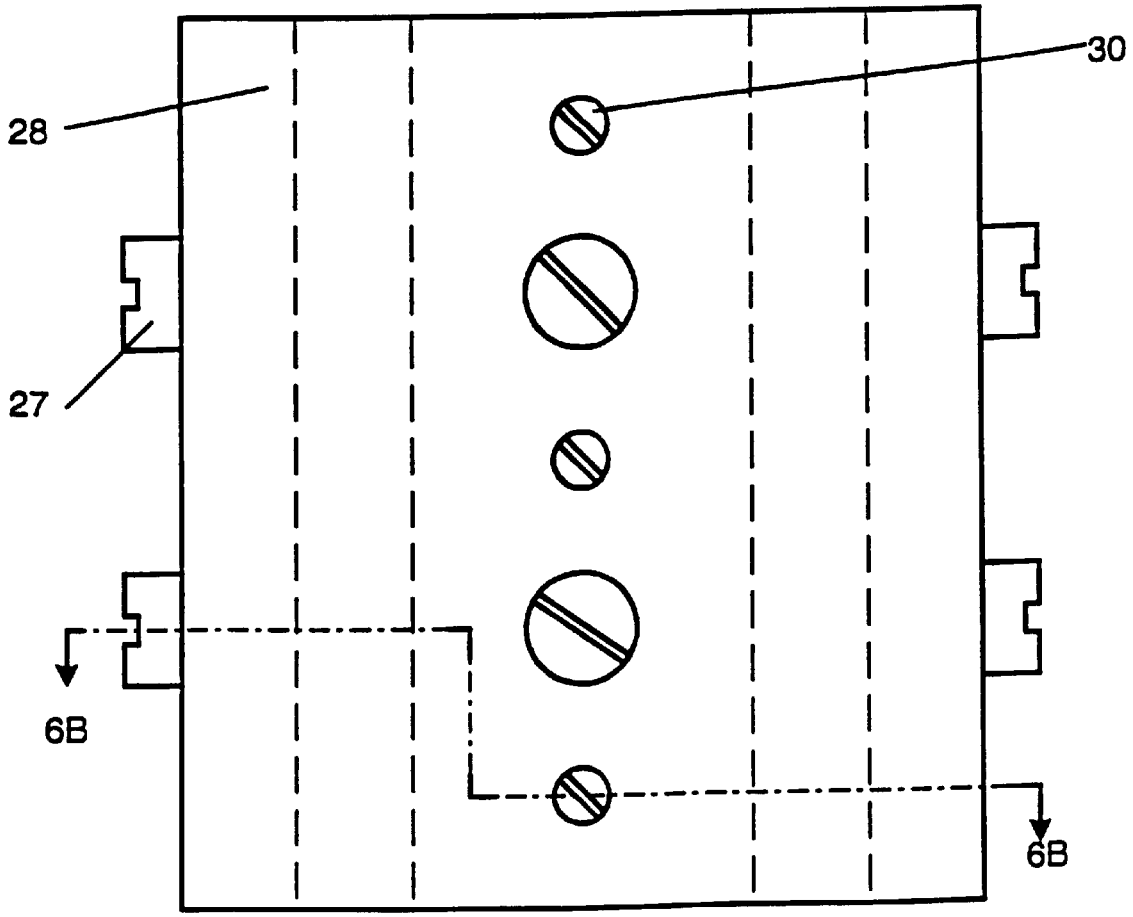
FIG. 6A and FIG. 6B show a construction that connect the four plates of plane constructed bushing by a connecting ring.
Figure 6B:
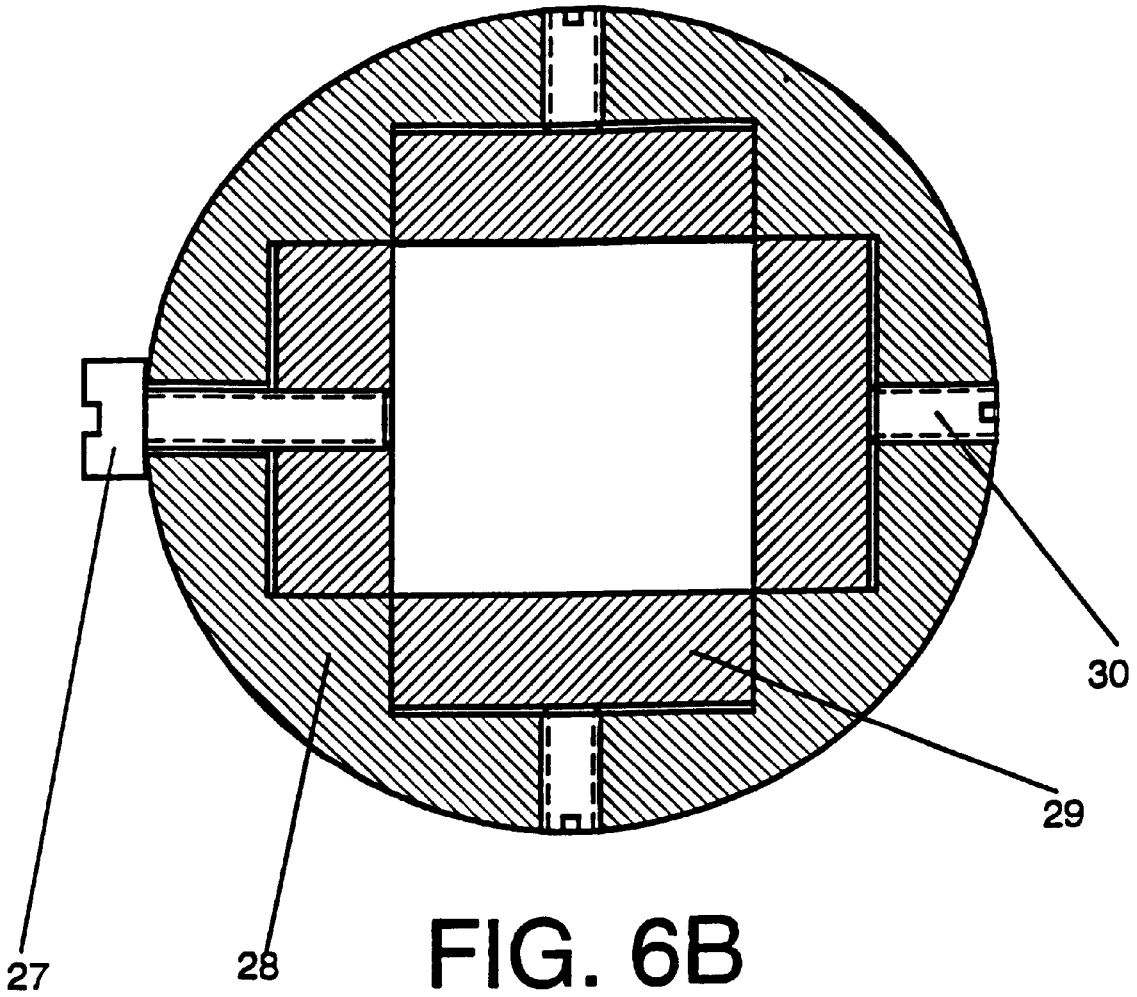

The clearance between shaft 17A and bushing 16A in Y-direction is controlled by the position of two plates 16A-2 in Y-direction. Since the diameter of the holes in plates 16A-2 is larger than the diameter of screw 23, the clearance between screw 23 and the holes permits the adjustment of the position of plates 16A-2 in the Y-direction. In assembling bushing 16A, the position of plates 16A-2 can be adjusted until the clearance between plates 16A-2 and shaft 17A is optimal, then fixed by tightening screw 23. Therefore, both the clearances in X-direction and Y-direction can be easily adjusted as needed. In order to make this connection reliable, some releasable glue can be used to fill the holes in plates 16A-2. The bushing can also be constructed of flat plates with different figure, for example, plates with trapezoidal section. These flat plates can be connected together by tenon joints or glue or screw. FIG. 5A is a possible bushing constructed of four flat plates with trapezoidal section 24A held in a sleeve 25 by means of epoxy 26. FIG. 5B is another possible bushing construction of four same plates with rectangular section 24B held in sleeve 25 and glued by epoxy 26. In these cases, the position of the plates is determined by the four corresponding surfaces of the shaft. In addition, the bushing can be constructed of four plates connected together by a third part, for example, a connecting ring 28 as shown in FIG. 6A and FIG. 6B. Each flat plate with tapped holes 29 is clamped to connecting ring 28 by connecting screws 27 and firmly fixed by tightening three set screws 30. Therefore, plates 29 can be adjusted by loosening and tightening screws 27 and 30 alternately to an optimum position needed.

Figure 7A:
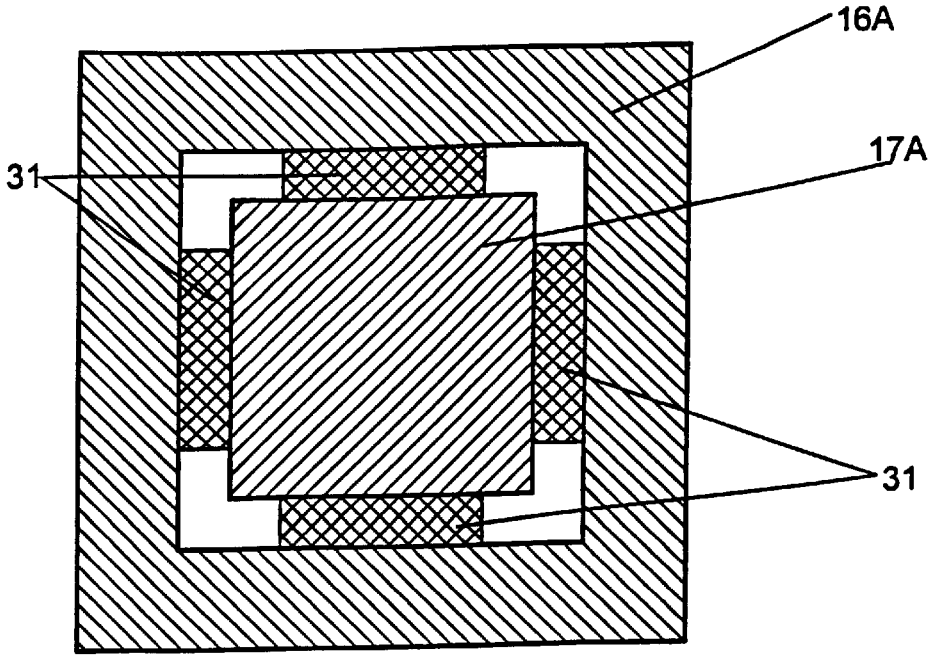
FIG. 7A and FIG. 7B show media between the bushing the shaft.
Figure 7B:
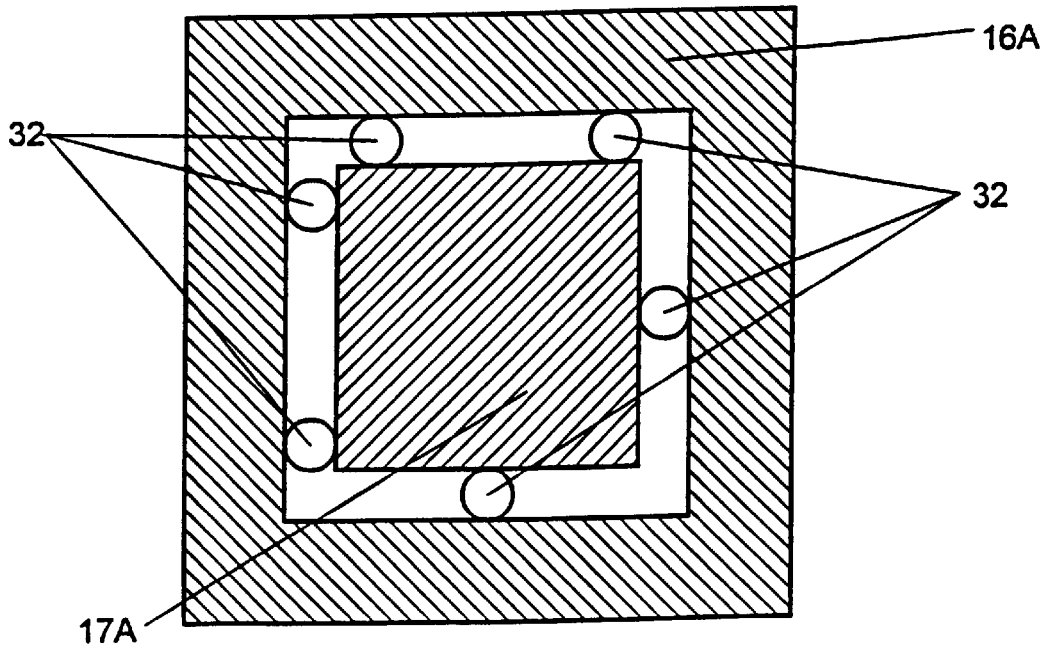

FIG. 7A and FIG. 7B show media between bushing 16A and shaft 17A. The media may include compressed air, fluid, plastic 31, ball bearings and roller bearings 32.

As the shaft and/or the bushing become worn after a long period of use, the shaft system can be disassembled, and the parts can be re-polished and then assembled again. Thus, the useful life of this shaft system can be prolonged indefinitely.

The precision polishing apparatus with plane constructed shaft system provides a highly reliable, easily manufactured, more accurate, and less costly device, which will better satisfy the demands of today's high technology manufacturing environment.

In order to know the actual pressure between the surface to be polished and pad 12, a ruler 22 is fixed on collar stop 18 (see FIG. 2). If a horizontal line is made on the periphery of load adjusting nut 21 as an index, then the displacement of nut 21 can be measured from ruler 22. From the amount of displacement of nut 21, the polishing pressure between the surface to be polished and pad 12 can be calculated. Assume that (1) the spring constant is K (Kg/mm), (2) the total weight of object 13, carrier 14 and shaft 17A is W (Kg), and (3) the displacement of nut 21 is d (mm). Then the pressure P between object 13 and pad 12 will be:

$$P=W-K\times d$$

Sometimes the surface to be polished is over polished in the course of conventional polishing due to negligence. In order to control the stock removal from the surface to be polished, a stock removal stop ring 20 is mounted on collar stop 18 as shown in FIG. 2. Ring 20 can be freely moved up and down on collar stop 18 and fixed by several set screws (not shown) in any position as needed. Adjusting the gap 'S' between ring 20 and nut 21 to the required stock removal amount before polishing will cause the stock removal to stop as soon as the gap 'S' becomes zero in the course of polishing.

While the invention has been described with reference to specific embodiments, modifications and variations of the invention may be constructed without departing from the scope of the invention, which is defined in the following claims.

I claim:

1. A plane constructed shaft system used in precision polishing apparatuses, comprising:

a) a four-surface prism shaft which is constructed of four flat planes, b) a four-surface hollow prism bushing around the shaft which is constructed of four flat plates, and c) a position of said flat plates can be adjusted during assembly.

2. The plane constructed shaft system according to claim 1, wherein said shaft can slide within said bushing, guided by said four flat plates, and further wherein the shaft and the bushing are spaced from each other, having media between said shaft and said bushing, wherein said media forms an additional bushing comprised of additional four flat planes or additional four flat plates, said additional flat planes being a guide surface for sliding of said shaft.

3. The system of claim 2, wherein the media are selected from a group consisting of compressed air, fluid, plastic, ball bearing, roller bearing, and combinations thereof.

4. The system of claim 1, further comprising a clearance between said shaft and said bushing, wherein the clearance between said shaft and said bushing is controlled by the position of said four flat plates of said bushing.

5. The system of claim 1, further comprising a device for calculating the polishing pressure in the course of polishing, the device comprising:

a) an index ruler mounted on the apparatus used to reveal position of a load adjusting nut, and b) an index line with scales attached to the periphery of said load adjusting nut used to represent the position of the nut, c) the polishing pressure can be calculated from said position of said load adjusting nut.

6. The system of claim 1, further comprising a device to stop stock removal in the course of polishing, comprised of a part directly or indirectly fixedly but releasably mounted on the shaft, and said part can be moved up and down according to the required stock removal amount.

7. The system of claim 6, wherein the part is a ring or a fraction of a ring.

8. The system of claim 1, further comprising connectors for connecting the plates, wherein the connectors are selected from a group consisting of screws, tenon joints, ring, glue, resin and combinations thereof.

9. The system of claim 1, wherein said four flat plates have a same sectional view.

10. The system of claim 1, wherein shapes of said four flat plates are different, and wherein the shapes are selected from a group consisting of rectangular and trapezoid shapes.

11. The system of claim 1, wherein the flat plates are connected to each other.

12. The system of claim 1, wherein the flat plates are duplicated together by a connecting part.

13. The system of claim 1, wherein the flat plates are duplicated from said prism by resin.

14. A plane constructed shaft apparatus for precision polishing apparatuses, comprising a four-surface prism shaft, a four-surface hollow prism bushing around the shaft having plural plates and an adjuster connected to the bushing for adjusting a position of said plural plates of the bushing during assembly.

15. The apparatus of claim 14, wherein the shaft is constructed of four flat planes.

16. The apparatus of claim 14, herein the bushing is constructed of four flat plates which are connected to each other.

17. The apparatus of claim 16, further comprising connectors for connecting plates.

18. The apparatus of claim 17, wherein the connectors are selected from a group consisting of screws, tenon joints, connecting ring, glue and resin.

19. The apparatus of claim 16, wherein the four plates have different shapes.

20. The apparatus of claim 19, wherein the shape is rectangular.

21. The apparatus of claim 19, wherein the shape is trapezoidal.

22. The apparatus of claim 16, wherein the shaft is slidable within the bushing guided by the four flat plates.

23. A The apparatus of claim 22, wherein said shaft and bushing are not in contact with each other, and wherein said shaft and bushing have a spacing from each other.

24. The apparatus of claim 23, further comprising media between the shaft and the bushing.

25. The apparatus of claim 24, wherein the media is selected from a group consisting of compressed air, fluid, plastic, ball bearings and roller bearings.

26. The apparatus of claim 23, wherein the plural plates comprise a first set of four flat plates, and wherein the spacing between the shaft and the bushing is controlled by a positioning of the first set of four flat plates of the bushing or a second set of four flat plates of an additional bushing.

27. A plane constructed shaft apparatus used in precision polishing apparatuses, comprising a flat-surface prism shaft which is constructed with flat planes, a flat-surface hollow prism bushing around the shaft, the bushing being constructed with flat plates which is connected to a remainder of the bushing, and an adjuster connected to the plates wherein the position of said flat plates is adjustable.

28. The plane constructed shaft apparatus according to claim 27, wherein said shaft slides within said bushing, guided by said flat plates, and further wherein the shaft and the bushing are separated by a bearing material between said shaft and said bushing, wherein the bearing material forms an additional bushing comprised of additional four flat plates or additional four flat planes being a guide surface for the sliding of said shaft.

29. The apparatus of claim 28, wherein the bearing material is a lubricant media selected from a group consisting of compressed air, fluid, a plastic,.ball bearing, roller bearing, and combinations thereof.

30. The apparatus of claim 27, further comprising a device for calculating a polishing pressure in the course of polishing, the device further comprising:

a) an index mounted on the apparatus used to reveal a position of a load adjusting nut, and b) an index with scales attached to the periphery of said load adjusting nut used to represent said position of the nut, c) a polishing pressure calculated from said position of said load adjusting nut.

31. The apparatus of claim 27, further comprising a device to stop stock removal in the course of polishing, comprised of a part directly or indirectly fixedly mounted on the shaft, and said part can be moved up and down according to the required stock removal amount.

32. The apparatus of claim 31, wherein the part is a ring.

33. The apparatus of claim 31, wherein the part is a fraction of a ring.

* * * * *

UNITED STATES PATENT AND TRADEMARK OFFICE

CERTIFICATE OF CORRECTION

PATENT NO. : 6,383,056 B1
DATED : May 7, 2002
INVENTOR(S) : Yin Ming Wang

It is certified that error appears in the above-identified patent and that said Letters Patent is hereby corrected as shown below:

Title page,
Item [56], References Cited, OTHER PUBLICATIONS, change “LOgitech” to -- Logitech --.

Column 4,
Line 43, change “24” to -- 2 --;
Line 47, cancel “des”.

Column 6,
Line 49, change “duplicated” to -- connected --;
Line 60, change “herein” to -- wherein --.

Column 7,
Line 9, cancel “A”.

Signed and Sealed this

Twenty-ninth Day of October, 2002

*Attest:*

*Attesting Officer*

JAMES E. ROGAN
*Director of the United States Patent and Trademark Office*